US005643149A

United States Patent [19]

Grimaldi et al.

[11] Patent Number: 5,643,149

[45] Date of Patent: Jul. 1, 1997

[54] FITNESS ROPE

[75] Inventors: Christine Grimaldi, East Hampton, N.Y.; Matthew Grimaldi, Los Angeles, Calif.; Stephen Hall, Surrey, Canada

[73] Assignee: Authentic Fitness Products, Inc., Van Nuys, Calif.

[21] Appl. No.: 611,652

[22] Filed: Mar. 6, 1996

[51] Int. Cl.[6] ..... A63B 21/02; A63B 5/22

[52] U.S. Cl. ..... 482/82; 482/126; 482/122

[58] Field of Search ..... 482/82, 121, 122, 482/126, 129, 124, 125, 139

[56] References Cited

U.S. PATENT DOCUMENTS

| | | | |
|---|---|---|---|
| 1,010,015 | 11/1911 | Caddy . | |
| 3,249,356 | 5/1966 | Schweitzer | 482/82 |
| 3,415,515 | 12/1968 | Otto . | |
| 4,093,211 | 6/1978 | Hughes et al. . | |
| 4,109,906 | 8/1978 | Wilson | 482/82 |
| 4,733,861 | 3/1988 | Plunkett, III | 482/82 |
| 4,756,527 | 7/1988 | Ledbetter | 482/139 |
| 4,934,691 | 6/1990 | Rudd . | |

FOREIGN PATENT DOCUMENTS

| | | | |
|---|---|---|---|
| 16447 | 5/1912 | United Kingdom | 482/82 |

*Primary Examiner*—Lynne A. Reichard

*Attorney, Agent, or Firm*—Amster, Rothstein & Ebenstein

[57] ABSTRACT

A fitness rope for use in both jumprope and stretching exercises is formed of a stretchable length of resiliently elastic rope. At each end of the stretchable rope length are a segment of flexible material secured at one end thereof to the stretchable rope length end, and a hollow handle of greater rigidity than the flexible segment. The handle is disposed at least in part about the flexible segment, slidable along a limited length of the flexible segment and rotatable relative to the flexible segment. Adjacent the other end of each of the flexible segments, both ends of the flexible segment are releasably joinable together to define a loop, including a respective one of the handles as a part thereof, the loop being configured and dimensioned to receive a limb or a support for use in stretching exercises.

8 Claims, 3 Drawing Sheets

FITNESS ROPE

BACKGROUND OF THE INVENTION

The present invention relates to a fitness rope and more particularly to a fitness rope having utility both as a jumprope and as a stretch rope (the latter being useful in stretching-type exercises).

Whether at home or in the gym, one may wish to work out successively with a jumprope having a length of rope with a handle at each end (for aerobic conditioning and timing) and with an elastic stretch rope having a loop at each end so that one may work the muscles of a limb placed in one loop against the muscles of another limb or a fixed support placed in the other loop. Traditionally, these are two separate piece of equipment, and a user must exchange the pieces of equipment involved in order to switch the exercise mode between jumprope and stretch rope.

U.S. Pat. Nos. 1,010,015 and 3,415,515 are representative of the prior art attempts to provide a "fitness rope" which combines the features of a jumprope and a stretch rope, thereby permitting the user to switch easily and rapidly between the two modes of exercise without having to obtain a different piece of exercise apparatus. The devices taught by these patents have not proven to be entirely satisfactory in use. Specifically, both patents teach the use of loops only, so that a person using the fitness rope for jumprope purposes may find use of the loop as a jumprope handle uncomfortable and/or disconcerting.

Accordingly, it is an object of the present invention to provide a fitness rope which is convertible between a jumprope and a stretch rope.

Another object is to provide such a fitness rope wherein handles are used for jumprope exercises and loops are used for stretch rope exercises.

It is a further object to provide such a fitness rope which is well adapted and comfortable for use as both a jumprope and a stretch rope.

It is another object of the present invention to provide such a fitness rope which is inexpensive and easy to manufacture, maintain and use.

SUMMARY OF THE INVENTION

It has now been found that the above and related objects of the present invention are obtained in a fitness rope for use in both jumprope and stretching exercises. The fitness rope comprises a stretchable length of resiliently elastic rope. At each end of the stretchable rope length, there is a segment of flexible material secured at one end thereof to the stretchable rope length end, and a hollow handle of greater rigidity than the flexible segment. The handle is disposed at least in part about the flexible segment, slidable along a limited length of the flexible segment and rotatable relative to the flexible segment. Adjacent the other end of each of the flexible segments is a means for releasably joining both ends of the flexible segment together to define a loop, including a respective one of the handles as a part thereof. The loop is configured and dimensioned to receive a limb or a support for use in stretching exercises.

In a preferred embodiment, each of the handles conceals from view a respective one of the stretchable rope length ends when the fitness rope is used for jumprope. Each of the handles preferably has an outer surface covered with foam. The stretchable rope length, when unstretched, is at least ten times the length of each of the flexible segments. The joining means joins both ends of the flexible segment together by joining each of the ends of the flexible segment to a respective stretchable rope length end.

The present invention also encompasses a method of converting a fitness rope from a jumprope orientation, wherein the fitness rope is suitable for use as a jumprope in jumping exercises and each releasable joining means thereof is at least partially concealed within a respective handle, to a stretchrope orientation, wherein the fitness rope is suitable for use as a stretchrope in stretching exercises and each releasable joining means thereof defines at least in part a respective loop. The method comprises the steps of providing a fitness rope for use in both jumprope and stretching exercises, and, at each end of the stretchable rope length, as necessary, removing the releasable joining means from the hollow handle and using it to releasably join both ends of the flexible segment together to define the loop for receiving a limb or support for stretching exercises.

The present invention further encompasses a method of converting a fitness rope from a stretchrope orientation, wherein the fitness rope is suitable for use as a stretchrope in stretching exercises and each releasable joining means thereof defines at least in part a respective loop, to a jumprope orientation, wherein the fitness rope is suitable for use in jumping exercises and each releasable joining means thereof is at least partially concealed within a respective handle. The method comprises the steps of providing a fitness rope for use in both jumprope and stretching exercises, and, at each end of the stretchable rope length, as necessary, releasing the releasable joining means to separate the ends of a flexible segment and moving the releasable joining means into the hollow handle to at least partially conceal the same.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
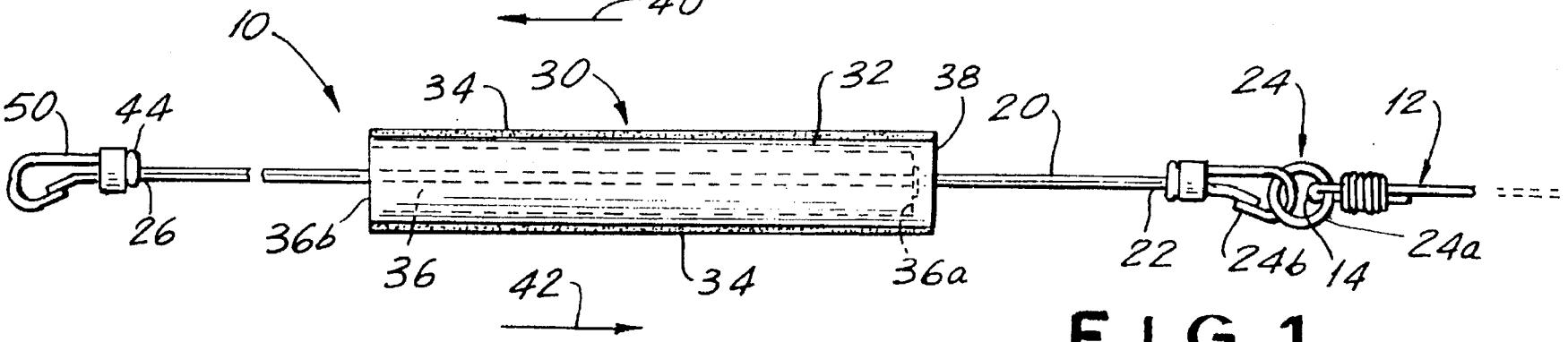
FIG. 1 is a fragmentary isometric view of the fitness rope in an intermediate configuration.

Referring now to the drawing, and in particular to FIG. 1 thereof, therein illustrated is a fitness rope according to the present invention, generally designated by the reference numeral 10. The fitness rope 10 is designed for use in both jumprope and stretching exercises (whether stretching one limb against another or one limb against a fixed support). The fitness rope comprises a stretchable length of a resiliently elastic rope, generally designated 12. The term "rope" as used herein and in the claims does not refer to the origin or composition of the material, but rather designates any flexible, relatively heavy cord. While it is typically of circular cross section, it need not necessarily be so. The cord may be formed of natural or synthetic fibers, such as plastic or rubber. The maximum diameter or thickness of the rope will generally be about one inch. Rope of this type is well known in the exercise arts as it is commonly used for stretching exercises wherein one limb of the body is isometrically tensed against another limb of the body or one limb (or both limbs) are tensed against a fixed support.

At each end 14 of the stretchable rope length 12, there is a segment of flexible material, generally designated 20, secured at one end 22 thereof to the stretchable rope length end 14. The stretchable rope length 12, when unstretched, is at least 10 times the length of the flexible segment 20. A variety of hooks, clasps, fasteners and like joining means 24 well known to those in the fastening art may be used for effecting joinder of the rope length end 14 and the segment end 22. Except for replacement of a failed element of the fitness rope of the present invention, there is no need to release either of the flexible segments 20 from the rope length 12 so that the ends 22, 14 thereof may be permanently secured together by the joining means 24. On the other hand, if it is desired to facilitate removal and replacement of damaged elements, a releasable joining means 24 may be used.

Figure 4:
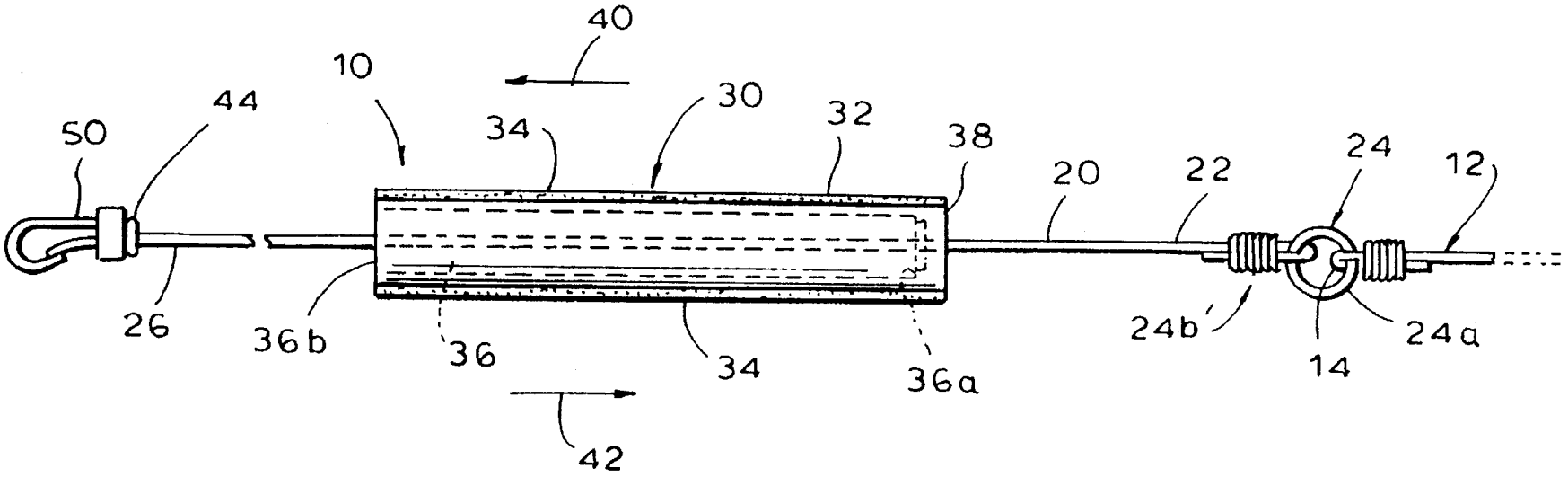
FIG. 4 is a fragmentary isometric view of an alternative embodiment of the fitness rope in an intermediate configuration.

In the embodiment illustrated in FIG. 1, the stretchable rope length end 14 passes through a loop **24*a* and secures the loop 24*a* to the stretchable rope length 12. The flexible segment end 22 is secured to a snap-action hook 24*b*. As illustrated, the two components of the securing means 24—the ring 24*a* and the hook 24*b*—are releasably interengageable and interlockable such that they cannot be accidentally separated. In the embodiment illustrated in FIG. 4, the flexible segment end 22 passes through the loop 24*a* and is permanently secured to the loop 24*a* by a loop 24*b*'**. As such securing means and equivalent ones are well known in the fastening art, further details will not be provided herein.

A hollow handle, generally designated 30, is of greater rigidity than the flexible segment 20. The handle 30 is disposed at least in part about the flexible segment 20, is slideable along the limited length of the flexible segment 20 and is rotatable relative to the flexible segment 20. The handle 30 may be formed substantially of a uniform composition, or it may have a relatively stiff inner core 32 with the outer surface of the core 32 surrounded by a softer layer 34 of foam rubber or foam sponge. The handle 30 defines a longitudinal passageway 36 through the inner core 32. The handle passageway 36 and/or the flexible segment 20 are preferably formed of, or at least have an outer surface of, a low-friction, non-wearing material (such as a plastic) which will facilitate relative longitudinal motion and/or relative rotational motion between the handle 30 and the flexible segment 20. The passageway 36 has two ends **36*a* and 36*b***.

Figure 2:
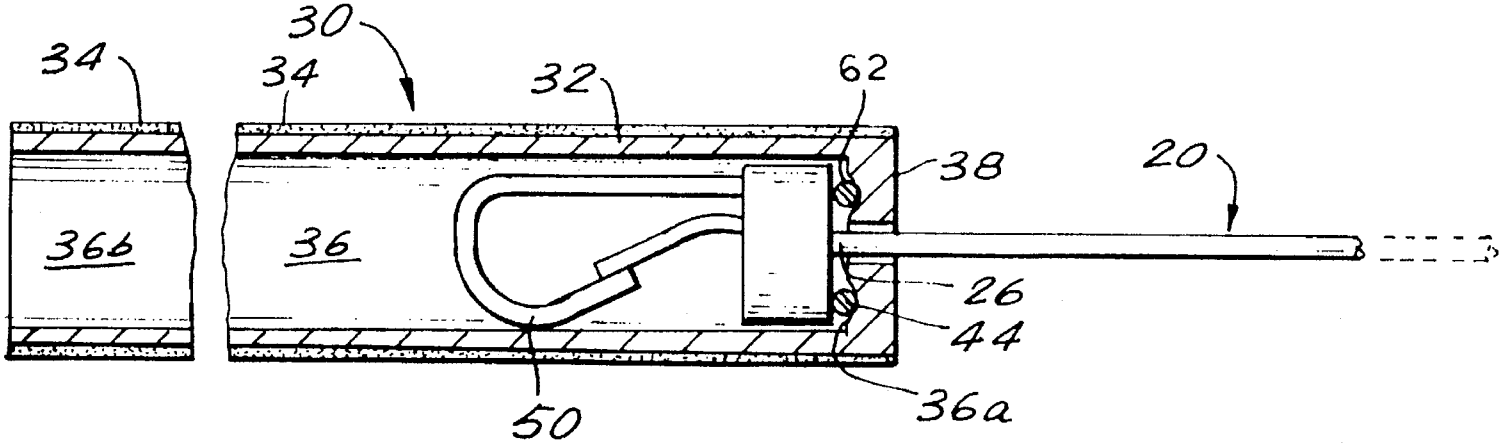
FIG. 2 is a similar view with the fitness rope in a jumprope configuration.

In order to limit the relative sliding longitudinal movement of the handle 30 along the flexible segment 20, thereby to ensure that no separation occurs therebetween, each of the ends 22, 26 of the flexible segment 20 may be configured and dimensioned to preclude passage thereof into the core passageway 36. In this case, however, when the fitness rope 10 is being used as a jumprope, the end 26 of the flexible segment 20 will project outwardly from the handle 30 and present a relatively unaesthetic appearance suggesting the bifunctionality of the rope. Accordingly, preferably the passageway 36 is of sufficient diameter to allow passage of end 26 of the flexible segment 20 thereinto, as illustrated in FIG. 2. In this instance, the passageway end 36a facing the segment end 22 is of reduced diameter due to the inwardly turned circumferential flange 38 so as to both preclude passage of the segment end 22 into the passageway 36 in the direction of arrow 40 and also limit movement of the segment end 26 through the passageway 36 in the direction of arrow 42.

A securing element 50—preferably one similar to hook **24*b*—is secured to the segment end 26 for movement therewith, the securing element 50 preferably being configured and dimensioned to pass with segment end 26 into passageway 36, where both are hidden from view when the fitness rope is used as a jumprope. The flange 38, which acts as a stop for the segment end 26, acts as well as a bearing surface which enables relative rotation of securing element 50 thereon without undue wearing of either. To this end, one or both of the facing surfaces of securing element 50 and flange 38 may be provided with a non-wearing, low-friction coating. Further, the facing surface of securing element 50 may be formed with a ring 44, shown in cross section in FIG. 2, and the facing surface of flange 38 may be formed with a concave surface 62**.

Figure 3:
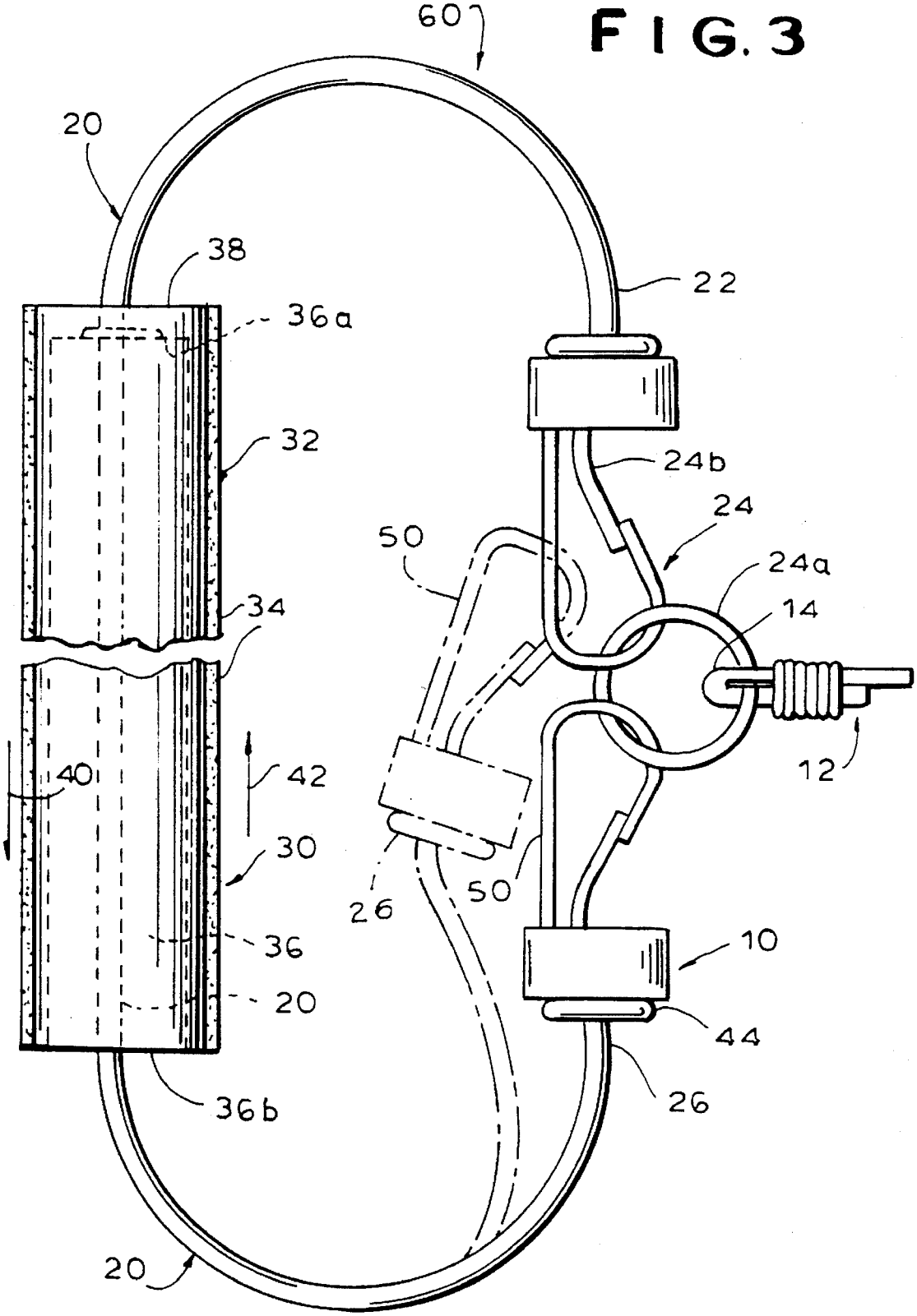
FIG. 3 is a similar view with the fitness rope in a stretch rope configuration, and with an alternative equivalent stretch rope configuration being illustrated in phantom line.

The securing element 50 is adapted to releasably engage and interlock with hook **24*b*—either directly with hook 24*b* or indirectly therewith via the ring 24*a*—such that the flexible segment 20 (including the handle 30 thereon) forms with the securing means 24*b*, 50 at the ends thereof—and, when the engagement is indirect, with a length of the ring 24*a* as well—a loop 60, as shown in FIG. 3. In other words, the securing means 24*b*, 50 engage one another either directly (i.e., when they directly engage one another as illustrated in phantom line in FIG. 3) or indirectly (i.e., when they separately engage the ring 24*a* on the stretchable rope length 12, as illustrated in sold line in FIG. 3). In either case, the loop 60** is configured and dimensioned to receive a limb (e.g., a hand or foot) or a support for use in stretching exercises.

Referring now in particular to FIG. 2, therein illustrated is the fitness rope 10 in its jumprope configuration. Relative to the intermediate configuration shown in FIG. 1, the flexible segment 20 has been pulled in the direction of arrow 42 relative to handle 30 until the end 26 thereof, and in particular the ring 44 thereof, abuts surface 62 of flange 38 and the full length of the securing element 50 attached thereto for movement therewith is contained within the passageway 36. In this jumprope configuration, the relative rotation of the flexible segment 20 (and especially the ring 44 at end 26 thereof) relative to the flange 38 enables the rope length 12 to undergo the conventional jumprope swiveling action relative to the handle 30. It will be appreciated that the handle 30 resembles a conventional jumprope handle as the flexible segment end 26 and the securing element 50 attached thereto are disposed within the handle passageway 36 and therefore concealed from view.

Referring now to FIG. 3 in particular, therein illustrated is the fitness rope 10 in its stretch rope configuration. Relative to the intermediate configuration shown in FIG. 1, the handle 30 has been moved in the direction of arrow 42 toward the segment end 22, if necessary, until it is about midway between the segment ends 22, 26. This exposes the segment end 26 and the securing element 50 attached thereto so that the securing element 50 may now be releasably joined with the securing means **24*b*—either directly or indirectly via the loop 24*a* on stretchable rope length end 14 (depending upon the type of construction involved)—in order to form the loop 60 including a relatively rigid middle portion (where the handle 30 is located) and softer ends (defined by the segment end portions extending beyond the handle 30** in each direction).

It is simple to convert the fitness rope from a jumprope orientation, wherein the fitness rope is suitable for use as a jumprope in jumping exercises and each releasable joining means thereof is at least partially concealed within a respective handle, to a stretchrope orientation, wherein the fitness rope is suitable for use as a stretchrope in stretching exercises and each releasable joining means thereof defines at least in part a respective loop. At each end of the stretchable rope length, as necessary, one has only to remove the releasable joining means from the hollow handle and use it to releasably join both ends of the flexible segment together to define the loop for receiving a limb or support for stretching exercises. It is also simple to convert the a fitness rope from a stretchrope orientation, wherein the fitness rope is suitable for use as a stretchrope in stretching exercises and each releasable joining means thereof defines at least in part a respective loop, to a jumprope orientation, wherein the fitness rope is suitable for use in jumping exercises and each releasable joining means thereof is at least partially concealed within a respective handle. At each end of the stretchable rope length, as necessary, one has only to release the releasable joining means to separate the ends of a flexible segment and move the releasable joining means into the hollow handle to at least partially conceal the same.

To summarize, the present invention provides a fitness rope which is convertible between a jumprope and a stretch rope. More particularly, handles are used for jumprope exercises, and loops are used for stretch rope exercises. The fitness rope is well adapted and comfortable to use as both a jumprope and a stretch rope, as well as being inexpensive and easy to manufacture, maintain and use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A fitness rope for use in both jumprope and stretching exercises, comprising:

(A) a stretchable length of resiliently elastic rope;

(B) at each end of said stretchable rope length, (i) a segment of flexible material secured at one end thereof to said stretchable rope length end, and (ii) a hollow handle of greater rigidity than said flexible segment, said handle being disposed at least in part about said flexible segment, slidable along a limited length of said flexible segment and rotatable relative to said flexible segment; and (C) adjacent the other end of each of said flexible segments, means for releasably joining both said ends of said flexible segment together to define a loop, including a respective one of said handles as a part thereof, said loop being configured and dimensioned to receive a limb or a support for use in stretching exercises.

2. The fitness rope of claim 1 wherein each of said handles conceals from view a respective one of said stretchable rope length ends when said fitness rope is used for jumprope.

3. The fitness rope of claim 1 wherein each of said handles has an outer surface covered with foam.

4. The fitness rope of claim 1 wherein said stretchable rope length when unstretched, is at least ten times the length of each of said flexible segments.

5. The fitness rope of claim 1 wherein said joining means joins both said ends of said flexible segment together by joining each of said ends of said flexible segment to a respective stretchable rope length end.

6. A fitness rope for use in both jumprope and stretching exercises, comprising:

(A) a stretchable length of resiliently elastic rope;

(B) at each end of said stretchable rope length, (i) a segment of flexible material secured at one end thereof to said stretchable rope length end, and (ii) a hollow handle of greater rigidity than said flexible segment, said handle being disposed at least in part about said flexible segment, slidable along a limited length of said flexible segment and rotatable relative to said flexible segment; and (C) adjacent the other end of each of said flexible segments, means for releasably joining both said ends of said flexible segment together to define a loop, including a respective one of said handles as a part thereof, said loop being configured and dimensioned to receive a limb or a support for use in stretching exercises;

each of said handles concealing from view a respective one of said stretchable rope length ends when said fitness rope is used for jumprope, each of said handles having an outer surface covered with foam, and said stretchable rope length, when unstretched, being at least ten times the length of each of said flexible segments.

7. A method of converting a fitness rope from a jumprope orientation, wherein the fitness rope is suitable for use as a jumprope in jumping exercises and each releasable joining means thereof is at least partially concealed within a respective handle, to a stretchrope orientation, wherein the fitness rope is suitable for use as a stretchrope in stretching exercises and each releasable joining means thereof defines at least in part a respective loop, comprising the steps of:

(1) providing a fitness rope for use in both jumprope and stretching exercises, comprising:

(A) a stretchable length of resiliently elastic rope;

(B) at each end of the stretchable rope length, (i) a segment of flexible material secured at one end thereof to the stretchable rope length end, and (ii) a hollow handle of greater rigidity than the flexible segment, the handle being disposed at least in part about the flexible segment, slidable along a limited length of the flexible segment and rotatable relative to the flexible segment; and (C) adjacent the other end of each of the flexible segments, means for releasably joining both ends of the flexible segment together to define a loop, including a respective one of the handles as a part thereof, the loop being configured and dimensioned to receive a limb or a support for use in stretching exercises; and (2) at each end of the stretchable rope length, as necessary, removing the releasable joining means from the hollow handle and using it to releasably join both ends of the flexible segment together to define the loop for receiving a limb or support for stretching exercises.

8. A method of converting a fitness rope from a stretchrope orientation, wherein the fitness rope is suitable for use as a stretchrope in stretching exercises and each releasable joining means thereof defines at least in part a respective loop, to a jumprope orientation, wherein the fitness rope is suitable for use in jumping exercises and each releasable joining means thereof is at least partially concealed within a respective handle, comprising the steps of:

(1) providing a fitness rope for use in both jumprope and stretching exercises, comprising:

(A) a stretchable length of resiliently elastic rope;

(B) at each end of the stretchable rope length, (i) a segment of flexible material secured at one end thereof to the stretchable rope length end, and (ii) a hollow handle of greater rigidity than the flexible segment, the handle being disposed at least in part about the flexible segment, slidable along a limited length of the flexible segment and rotatable relative to the flexible segment; and (C) adjacent the other end of each of the flexible segments, means for releasably joining both ends of the flexible segment together to define a loop, including a respective one of the handles as a part thereof, the loop being configured and dimensioned to receive a limb or a support for use in stretching exercises; and (2) at each end of the stretchable rope length, as necessary, releasing the releasable joining means to separate the ends of a flexible segment and moving the releasable joining means into the hollow handle to at least partially conceal the same.

* * * * *